United States Patent [19]

Baldwin et al.

[11] 4,253,921

[45] Mar. 3, 1981

[54] ELECTROCHEMICAL SYNTHESIS OF BUTANE-1,4-DIOL

[75] Inventors: Maynard M. Baldwin, Columbus; Robert E. Wyant, Delaware; Luther E. Vaaler, Columbus, all of Ohio

[73] Assignee: Battelle Development Corporation, Columbus, Ohio

[21] Appl. No.: 128,817

[22] Filed: Mar. 10, 1980

[51] Int. Cl.[3] ..... C25B 3/10; C25B 3/04

[52] U.S. Cl. ..... 204/72; 204/59 R; 204/77

[58] Field of Search ..... 204/59 R, 72, 73 R, 204/76, 77

[56] References Cited

U.S. PATENT DOCUMENTS

| | | | |
|---|---|---|---|
| 3,399,124 | 8/1968 | Gilch | 204/72 |
| 3,876,514 | 4/1975 | Baizer | 204/59 R |
| 4,097,344 | 6/1978 | Drury | 204/59 R |
| 4,098,657 | 7/1978 | Kay et al. | 204/59 R |

FOREIGN PATENT DOCUMENTS

| | | | |
|---|---|---|---|
| 9603 | of 1909 | United Kingdom | 204/72 |
| 1145372 | 3/1969 | United Kingdom | 204/72 |

OTHER PUBLICATIONS

Cipris, J. Applied Electrochem., vol. 8, pp. 537–547 (1978).

Jennings et al, J. Org. Chem., vol. 41, No. 4, pp. 719–722 (1975).

Hall et al, J. Org. Chem., vol. 43, No. 22, pp. 4364–4366 (1978).

Plump et al, J. Electrochem. Soc., vol. 73, pp. 533–538 (1938).

*Primary Examiner*—F. C. Edmundson

*Attorney, Agent, or Firm*—Sidney W. Millard

[57] ABSTRACT

Disclosed is a method for making an α-, ω-dihydroxy-terminated alkane, preferably butane-1,4-diol, by cathodically coupling a polymethylene halohydrin, preferably ethylene bromo-, or iodohydrin, in an aqueous elctrolytic bath maintained at a pH of between about 8 and 10.

34 Claims, No Drawings

ELECTROCHEMICAL SYNTHESIS OF BUTANE-1,4-DIOL

BACKGROUND OF THE INVENTION

The present invention relates to the synthesis of butane-1,4-diol and more particularly to its synthesis electrochemically from halohydrins.

A variety of chemical synthesis techniques are employed commercially to produce butane-1,4-diol; however, no successful electrochemical synthesis of butane-1,4-diol (herein often referred to as butanediol) has yet been developed. Cipris (*Journal of Applied Electrochemistry*, 8, 537–544 and 545–547, 1978) attempted the electrochemical reductive coupling of 2-chloroethanol and of 2-bromoethanol to form butanediol. No diol yield was realized by Cipris. Instead, ethylene, hydrogen gas, and ethers were the only products realized by the particular electrochemical reductive coupling method attempted. Cipris reports the use of predominantly anhydrous solvent systems containing at most up to about 5% water. Electrolytes used included tetraalkylammonium halides or para-toluenesulfonates, or lithium halides or para-toluenesulfonates. Sulfuric acid was the anolyte of choice.

Further study in electrochemical reductive couplings were conducted by Hall et al (*J. Org. Chem.*, Vol. 41, No. 4, pp. 719–722, 1975; and Vol. 43, No. 22, pp. 4364–4366, 1978) on 1-bromooctane, 1-bromobutane, 2-bromobutane, and 2-bromo-2-methyl butane. Aluminum and nickel electrodes were studied with aluminum being the preferred cathode for use with a catholyte bath consisting of iron acetylacetonate, triphenyl phosphine, and tetrabutylammonium bromide. For an expanded discussion concerning reaction mechanisms for electrolytic reductions, reference is made to Hammett (*J. Electrochem. Soc.*, 73, 523–538, 1938).

The present invention provides a method for electrochemically preparing butanediol which heretofore has eluded the art.

BROAD STATEMENT OF THE INVENTION

The present invention is a method for electrochemically preparing an $\alpha$, $\omega$-polymethylene diol from a polymethylene halohydrin. The method comprises establishing an electrolytic cell, an aqueous electrolytic bath comprising water, an electrolyte, an adequate proportion of a base to establish a pH in said bath not substantially below 7, and the polymethylene halohydrin. The halogen substituent of the polymethylene halohydrin is bromine or iodine and the polymethylene substituent contains between about 2 and 6 methylene groups and preferably two methylene groups. The electrolytic cell has an anode and a cathode disposed in said bath. The cathode is either copper, silver, nickel, or zinc. An electric potential is impressed between the anode and cathode to generate a current through the bath to cathodically couple the electrolyzed polymethylene halohydrin to form said diol. The pH of the bath preferably is maintained between about 8 and 10 during the process.

DETAILED DESCRIPTION OF THE INVENTION

Several unexpected critical factors were determined to be necessary to achieve the desired cathodic coupling reaction for forming the desired butanediol product. Initially, work on the present invention revealed that cathodic coupling of chlorohydrins were unsuccessful, though a variety of catholyte baths and cathodes were evaluated. For example, solvents for the catholyte bath included water admixed with acrylonitrile, acetonitrile, dimethylformamide, propylene carbonate, and sulfolane. Catholytes tested included ammonium halides and quaternary ammonium sulfonates. Additionally, water-ethanol solvents were evaluated and even dimethylformamide neat. The baths contained various proportions of bases which varied the pH from as low as about 5.6 on up to about 11.1 and currents used ranged from as low as about 0.2 amps on up to 3 amps. Cathodes evaluated included copper screen and mercury.

However, further work on the present invention revealed that bromohydrin and iodohydrin feedstocks do permit the cathodic coupling to take place provided that other reaction and process conditions are carefully maintained. Suitable feedstock for admission to the present invention, then, include polymethylene halohydrins wherein the halogen group is bromine or iodine. The polymethylene substituent can contain between about 2 and 6 methylene groups, inclusive. The preferred feedstock for the present invention is ethylene halohydrin for producing butanediol, though the other polymethylene halohydrins disclosed herein can be cathodically coupled according to the precepts of the present invention.

These additional critical factors or reaction conditions necessary for achieving cathodic coupling in the present invention include the use of an aqueous electrolytic bath which has a carefully maintained pH. The pH of the bath should be greater than about 7 and preferably between about 8 and 10. At a pH of around 7, yields are low and at pHs above 10 little increased yields are to be expected at the expense of extra base necessary for maintenance of such a high pH level. A pH of around 9 appears to be extremely satisfactory for successful practice of the invention. Work on the present invention did reveal that low pHs unexpectedly do not permit the desired cathodic coupling reaction to occur for production of butanediol. The pH may be maintained by a suitable base which is adequately soluble in the solvent system of choice. Suitable bases include alkali metal bases such as alkali metal hydroxides, ammonium bases such as ammonium hydroxide, quaternary ammonium bases such as quaternary ammonium hydroxides, and the like. Since the pH is lowered during the reaction, presumably due to the formation of hydrogen halide, incremental additions of base to the bath during the course of the electrolytic reaction serves to maintain the pH of the bath within the desired range.

Various water-soluble organic solvents also may be combined with water though water alone may be used. Such additional organic solvents preferably are alcohols with lower alkanols, such as ethanol, being preferred. Other suitable solvents include, for example, glycols (such as ethylene glycol, propylene glycol and the like), cyclohexanol, and the like. The weight ratio of water to the preferred organic solvent ethanol can range from about 10:1 to 1:5 and advantageously is about 1:0.8.

Another surprising factor determined during work on the present invention was that conventionally popular electrodes such as mercury, lead, and aluminum do not work in the present process for the cathodic coupling reaction to produce butanediol. The reason that these metals do not work is not fully understood. Cathodes which do work in the present invention include preferably copper and also silver, iron, nickel, and zinc. While a solid plate electrode of the correct metal will permit small yields at increased current levels, cathodes with extremely large surface areas have been determined to be clearly preferred for the present invention. Thus, various techniques for plating the metal of choice onto a copper electrode, for example, are recommended. Such techniques include plating the metal from a suitable salt solution thereof, sputtering or vapor deposition of the metal, and like techniques which provide desirable deposits of the metal for achieving suitable surface areas on the cathode substrate. Further in this regard, electrodes having the geometric form of a screen or the like additionally contribute to high surface areas which increase yields of the desired butanediol product. The examples will further detail the cathode and its surface area relationship in the present invention.

The electrolytic cell desirably is divided into an anode compartment and a cathode compartment by conventional porous membranes including ceramic membranes, porous metal membranes, porous resin membranes including ionic membranes, and the like. Separation of the reactions and products at the two electrodes is preferred for minimizing undesirable by-product formation and for ease in recovering the products of the reaction; however, it must be recognized that an undivided cell would allow lower voltages to be used in the process.

A variety of conventional electrolytes (catholytes and anolytes) can be used in the electrolytic bath which is placed in the electrolytic cell for practice of the present process. It does not appear that any particular electrolyte is critical for successful practice of the invention so long as a suitable soluble base is disposed in the bath for maintaining the requisite critical pH range for successful synthesis of butanediol product in the present invention. However, ammonium and quaternary ammonium salts containing very bulky alkyl substituents may somewhat retard otherwise expected yields of butanediol in the process though butanediol still will be produced. Advantageous catholytes include amine salts, ammonium salts, quaternary ammonium salts, alkali metal salts, and the like, though ammonium salts (eg. ammonium halides) are preferred. Additionally catholytes are those delineated in U.S. Pat. No. 3,475,298, the disclosure of which is expressly incorporated herein by reference.

Preferably, the anolyte is the same as the catholyte for economy and simplicity in operating the present invention, though a variety of anolytes may be used for successfully practicing the present invention.

In practicing the present invention, the halohydrin feedstock is dispersed in the solvent at a weight concentration from as little as 5% by weight of the aqueous solvent on up to 50% or greater. Weight concentrations of the feedstock by weight of the solvent advantageously range from about 20%–50% or thereabouts. A minimum current probably is needed to induce the coupling reaction in order to realize practical yields. It will be understood that the current required for the coupling reaction will vary depending upon several factors in the process (eg. bath temperature, type of catholyte and its concentration, type of halohydrin feed and its concentration, proximity of the electrodes, presence and type of porous membrane, type and surface area of the cathode, etc.). Currents as low as 0.5 amps on up to 3 amps or more have been found to work in the process. Stirring of the cell's contents also is preferred for increasing the mass transfer of the system, i.e. removal of products from the electrode and movement of reactants to the electrode for reaction. The temperature of the bath does not appear to be critical and room temperature operation clearly is preferred for overall economy and ease in practicing the present invention. It can be said that generally as the feedstock concentration is increased that the yields increase. However, it appears that the yields will be increased by a greater degree by increasing the current which passes through the bath.

It should be noted that the major by-product detected during work on the present invention was ethylene gas. Though the process must be conducted in an aqueous bath, no appreciable hydrogen gas evolution was detected. Using a bromohydrin feedstock, for example, a pool of bromine collected at the bottom of the anode compartment. It is surprising that apparently no decomposition of water is taking place during the electrolysis reaction in the present invention. Halogen product desirably is used to make additional halohydrin feedstock for recycle to the process. Any ethylene product may be reacted with halogen product for this purpose.

The following examples show how the present invention can be practiced but should not be construed as limiting. In this application all percentages and proportions are by weight and all units are in the metric system, unless otherwise expressly indicated.

IN THE EXAMPLES

The electrolytic cell used in the examples was a jacketed glass vessel having cooling water circulated through the jacket. The vessel was placed on a cold plate for additional temperature control. The cold plate had a stirrer for rotating a magnetic stir bar placed in the bottom of the vessel. A porous ceramic cup placed in the center of the cell formed the anode compartment and contained a coiled platinum wire which served as the anode. The cathode was cylindrical and approached the inside diameter of the cell in size. The cathode compartment also contained a thermometer and reference calomel electrode.

For electrodes of copper, zinc, nickel, silver, and lead, a copper-base screen was electroplated with the metal by conventional techniques. The copper screen was a copper/bronze alloy, 14×18 mesh measuring 6.35 cm in diameter by 5.7 cm high. For the mercury cathode runs, the mercury was formed as a pool on the bottom of the cell and connected to an insulated molybdenum wire. Analysis of products was accomplished by conventional gas chromatography techniques.

The following terms are used in the examples:

EtOH=ethanol
$H_2O$=water
$BrC_2H_4OH$=ethylene bromohydrin
$NH_4Cl$=ammonium chloride
$Bu_4NCl$=tetrabutylammonium chloride
$NH_4OH$=ammonium hydroxide
$Me_4NCl$=tetramethylammonium chloride
TET=tetraethylammonium p-toluenesulfonate
$IC_2H_4OH$=ethylene iodohydrin
EDA.2HCl=ethylenediamine.dihydrogen chloride
$MeNH_2.HCl$=methylamine.hydrogen chloride

EXAMPLE 1

This example evaluates ethylene chlorohydrin as a feedstock for the process. In runs 13–16, the bath consisted of 95 gm of $H_2O$, 82.88 gm. of ethanol, 13.6 ml of 28% aqueous ammonium hydroxide, and 17.2 gm. of ethylene chlorohydrin. In run 17, the bath consisted of 133.55 gms. of dimethylformamide (DMF) and 17.2 gm. of ethylene chlorohydrin. In run 91, the bath consisted of 17.36 gm. of ethanol, 22 gm. of water, 13.91 gm. of ethylene chlorohydrin, 5 gm. of $NH_4Br$, and 3.47 ml of 28% aqueous $NH_4OH$. A copper plated screen served as the electrode. The following results were obtained.

TABLE 1

| Run No. | Current Amp | Current Amp-Hr. | pH | Yield (wt %) |
|---|---|---|---|---|
| 13 | 0.2 | 8.3 | 8.6 | 0 |
| 14 | 0.2 | 11.2 | 8.3 | 0 |
| 15 | 1.6 | 3.7 | 9.1 | 0 |
| 16 | 1.75–1.65 | 4 | 9.3 | 0 |
| 17 | 0.2 | 3.8 | 9.1 | 0 |
| 91 | 0.6 | 1.2 | 9.2–9.5 | 0 |

The foregoing tabulated results show that ethylene chlorohydrin cannot be cathodically coupled to form butanediol using a copper electrode. It should be noted that no yield could be detected for a mercury cathode either using these solvents with water: acrylonitrile, acetonitrile, DMF, propylene carbonate, and sulfolane.

EXAMPLE 2

In this example, ethylene bromohydrin was the feedstock and the bath contained no water. A copper-coated copper screen served as the cathode. In runs 27 and 28, the catholyte bath consisted of 78.9 gm. of ethanol, 70 gm of TET, 10 gm. of boric acid, and 17.6 gm. of ethylene bromohydrin. In run 29, the catholyte bath consisted of 109.7 gm. of DMF, 60 gm. of TET, 7.5 gm. of tetraethylammonium hydroxide, and 17.6 gm. of ethylene bromohydrin. The anolyte was TET for all runs. The following results were obtained.

TABLE 2

| Run No. | Current Amp | Current Amp-Hr. | pH range | Yield (wt %) |
|---|---|---|---|---|
| 27 | 1.8 | 1.8 | 9.2–6.0 | 0 |
| 28 | 1.8 | 1.8 | 8.6–10.0 | 0 |
| 29 | 1.8 | 3.75 | 9.3–2.0 | 0 |

The above-tabulated results show that ethylene bromohydrin cannot be coupled to butanediol using a non-aqueous solvent.

EXAMPLE 3

In this example, a copper-plated copper screen cathode was used with the following catholyte bath: 70.03 gm. of ethanol, 100 gm. of $H_2O$, 17.2 gm. of ethylene bromohydrin, 10.7 gm. of $NH_4Cl$, and 14 ml. of 28% aqueous $NH_4OH$. The anolyte was 5 gm of TET in 35 ml of $H_2O$. The following results were obtained.

TABLE 3

| Run No. | Current Amp. | Current Amp.-Hr. | pH | Yield (wt %) |
|---|---|---|---|---|
| 35 | 0.75 | 1.0 | 9 | 1 |
| 21 | 0.3 | 4.8 | 9 | 1 |
| 36 | 1.5 | 0.75 | 9 | 0 |
| 30 | 1.5 | 1.5 | 9 | 7 |
| 31 | 1.5 | 4.5 | 9 | 20 |
| 32 | 1.5 | 4.5 | 9 | 21 |
| 18 | 1.5 | 4.5 | 9–8.2 | 21 |
| 38 | 1.5 | 3.0 | 9 | 24 |
| | | 4.5 | | 24 |
| | | 8.25 | | 37 |
| 39 | 0.75 | 3.37 | 9 | 16 |
| | | 5.25 | | 14 |
| | | 9.75 | | 18 |
| | | 10.5 | | 20 |

The copper screen electrodes in runs 38 and 39 were previously used plated screens which had been replated. The above-tabulated results demonstrate that increased yields are realized with increasing electrolysis times and that an apparent threshold current level exists for driving the coupling reaction to the desired diol product.

EXAMPLE 4

In this example, a variety of reaction conditions were evaluated in order to assess their importance in the process of the present invention. The following results were obtained.

TABLE 4A

| Run No. | Catholyte Comp. | Catholyte gm. | $BrC_2H_4OH$ (wt %) | Anolyte comp. | Anolyte gm. | Current amp. | Current amp.-Hr. | pH range | Yield (wt %) |
|---|---|---|---|---|---|---|---|---|---|
| 60 | EtOH | 60 | 17.08 | $H_2SO_4$ | 5.6 | 1.5 | 12 | 1.3–2.65 | 0 |
| | $H_2O$ | 76 | | $H_2O$ | 100 | | | | |
| | $BrC_2H_4OH$ | 23.23 | | | | | | | |
| | $Bu_4NCl$ | 4.5 | | | | | | | |
| 64 | EtOH | 17.76 | 13.8 | $NH_4Cl$ | 0.5 | 0.6 | 1.2 | 1.3–8.75 | 3.52 |
| | $H_2O$ | 22.5 | | $H_2O$ | 4.5 | | | (6–7 avg.) | |
| | $BrC_2H_4OH$ | 6.8 | | | | | | | |
| | $NH_4Cl$ | 2.3 | | | | | | | |
| 69 | EtOH | 17.76 | 13.9 | $NH_4Cl$ | 0.7 | 0.6 | 1.2 | 1.35–7.35 | 1.4 |
| | $H_2O$ | 22.5 | | $H_2O$ | 6.3 | | | (7.0 avg.) | |
| | $BrC_2H_4OH$ | 6.88 | | | | | | | |
| | $NH_4Cl$ | 2.3 | | | | | | | |
| 76 | EtOH | 17.36 | 36.10 | $NH_4Cl$ | 0.7 | 0.6 | 1.2 | 9.0–7.0 | 2.20 |
| | $H_2O$ | 22 | | $H_2O$ | 6.3 | | | (8 avg.) | |
| | $BrC_2H_4OH$ | 14.21 | | | | | | | |
| | $NH_4Cl$ | 2.73 | | | | | | | |
| | $NH_4OH$ | 3.47 | | | | | | | |

TABLE 4B

| Run | Catholyte | | $BrC_2H_4OH$ | Anolyte | | Current | | pH | Yield |
|---|---|---|---|---|---|---|---|---|---|
| No. | Comp. | gm. | (wt %) | comp. | gm. | amp. | amp.-Hr. | range | (wt %) |
| 48 | EtOH | 75 | 8.54 | $NH_4Cl$ | 3 | 1.5 | 12 | 9.5–7.5 | 12.53 |
| | $H_2O$ | 95 | | $H_2O$ | 30 | | | | |
| | $BrC_2H_4OH$ | 14.52 | | | | | | | |
| | $NH_4Cl$ | 10.14 | | | | | | | |
| | $NH_4OH$ | 12.92 | | | | | | | |
| 49 | EtOH | 75 | 8.54 | $NH_4Cl$ | 3 | 1.5 | 6 | 9.35–9.0 | 10.0 |
| | $H_2O$ | 95 | | $H_2O$ | 30 | | | | |
| | $BrC_2H_4OH$ | 14.52 | | | | | | | |
| | $NH_4Cl$ | 10.17 | | | | | | | |
| | $NH_4OH$ | 12.92 | | | | | | | |
| 52 | EtOH | 71 | 8.54 | $NH_4Cl$ | 3 | 1.5 | 6 | 9.4–9.0 | 6.23 |
| | $H_2O$ | 90 | | $H_2O$ | 30 | | | | |
| | $BrC_2H_4OH$ | 13.75 | | | | | | | |
| | $NH_4Cl$ | 9.63 | | | | | | | |
| | $NH_4OH$ | 12.24 | | | | | | | |
| 53 | EtOH | 71 | 8.54 | $NH_4Cl$ | 3 | 1.5 | 6 | 9.4–9.0 | 6.51 |
| | $H_2O$ | 90 | | $H_2O$ | 30 | | | | |
| | $BrC_2H_4OH$ | 13.75 | | | | | | | |
| | $NH_4Cl$ | 9.63 | | | | | | | |
| | $NH_4OH$ | 12.24 | | | | | | | |
| 55 | EtOH | 71 | 8.54 | $NH_4Cl$ | 3 | 1.5 | 6 | 9.3–9.0 | 7.51 |
| | $H_2O$ | 90 | | $H_2O$ | 30 | | | | |
| | $BrC_2H_4OH$ | 13.75 | | | | | | | |
| | $NH_4Cl$ | 9.63 | | | | | | | |
| | $NH_4OH$ | 12.24 | | | | | | | |

TABLE 4C

| Run | Catholyte | | $BrC_2H_4OH$ | Anolyte | | Current | | pH | Yield |
|---|---|---|---|---|---|---|---|---|---|
| No. | Comp. | gm. | (wt %) | comp. | gm. | amp. | amp.-Hr. | range | (wt %) |
| 50 | EtOH | 71.46 | 17.93 | $NH_4Cl$ | 3 | 1.5 | 6 | 9.4–8.9 | 11.75 |
| | $H_2O$ | 90.53 | | $H_2O$ | 30 | | | | |
| | $BrC_2H_4OH$ | 29.04 | | | | | | | |
| | $NH_4Cl$ | 9.69 | | | | | | | |
| | $NH_4OH$ | 12.31 | | | | | | | |
| 56 | EtOH | 67.1 | 17.92 | $NH_4Cl$ | 3 | 1.5 | 6 | 9.2–9.0 | 12.3 |
| | $H_2O$ | 85 | | $H_2O$ | 30 | | | | |
| | $BrC_2H_4OH$ | 27.26 | | | | | | | |
| | $NH_4Cl$ | 9.1 | | | | | | | |
| | $NH_4OH$ | 11.56 | | | | | | | |
| 58 | EtOH | 67.1 | 17.92 | $NH_4Cl$ | 3 | 1.5 | 12 | 9.5–8.45 | 9.08 |
| | $H_2O$ | 85 | | $H_2O$ | 30 | | | | |
| | $BrC_2H_4OH$ | 27.26 | | | | | | | |
| | $NH_4Cl$ | 9.05 | | | | | | | |
| | $NH_4OH$ | 11.56 | | | | | | | |
| 61 | EtOH | 67.1 | 17.92 | $NH_4Cl$ | 3 | 3.0 | 12 | 8.85–9.35 | 21.0 |
| | $H_2O$ | 85 | | $H_2O$ | 27 | | | | |
| | $BrC_2H_4OH$ | 27.26 | | | | | | | |
| | $NH_4Cl$ | 9.1 | | | | | | | |
| | $NH_4OH$ | 11.56 | | | | | | | |
| 62 | EtOH | 19.9 | 18.14 | $NH_4Cl$ | 0.5 | .95 | 1.9 | 8.95–9.4 | 19.6 |
| | $H_2O$ | 25.2 | | $H_2O$ | 4.5 | | | | |
| | $BrC_2H_4OH$ | 8.18 | | | | | | | |
| | $NH_4Cl$ | 2.73 | | | | | | | |
| | $NH_4OH$ | 3.47 | | | | | | | |

TABLE 4D

| Run | Catholyte | | $BrC_2H_4OH$ | Anolyte | | Current | | pH | Yield |
|---|---|---|---|---|---|---|---|---|---|
| No. | Comp. | gm. | (wt %) | comp. | gm. | amp. | amp.-Hr. | range | (wt %) |
| 66 | EtOH | 0 | 32.30 | $NH_4Cl$ | 0.5 | 0.6 | 1.2 | 8.9–9.17 | 5.66 |
| | $H_2O$ | 44 | | $H_2O$ | 4.5 | | | | |
| | $BrC_2H_4OH$ | 14.21 | | | | | | | |
| | $NH_4Cl$ | 2.73 | | | | | | | |
| | $NH_4OH$ | 3.47 | | | | | | | |
| 84 | EtOH | 17.36 | 36.10 | $NH_4Br$ | 0.7 | 0.6 | 1.2 | 8.9–9.1 | 4.21 |
| | $H_2O$ | 22 | | $H_2O$ | 6.3 | | | | |
| | $BrC_2H_4OH$ | 14.21 | | | | | | | |
| | $NH_4Br$ | 5.0 | | | | | | | |
| | $NH_4OH$ | 3.47 | | | | | | | |
| 70 | EtOH | 17.36 | 36.10 | $NH_4Cl$ | 0.7 | 0.6 | 1.2 | 8.9–9.05 | 9.86 |
| | $H_2O$ | 22 | | $H_2O$ | 6.3 | | | | |
| | $BrC_2H_4OH$ | 14.21 | | | | | | | |
| | $NH_4Cl$ | 2.73 | | | | | | | |
| | $NH_4OH$ | 3.47 | | | | | | | |
| 63 | EtOH | 13.42 | 82.91 | $NH_4Cl$ | 0.5 | 0.7 | 2.8 | 8.85–9.2 | 14.2 |

TABLE 4D-continued

| Run No. | Catholyte Comp. | Catholyte gm. | $BrC_2H_4OH$ (wt %) | Anolyte comp. | Anolyte gm. | Current amp. | Current amp.-Hr. | pH range | Yield (wt %) |
|---|---|---|---|---|---|---|---|---|---|
| | $H_2O$ | 17 | | $H_2O$ | 4.5 | | | | |
| | $BrC_2H_4OH$ | 25.22 | | | | | | | |
| | $NH_4Cl$ | 2.73 | | | | | | | |
| | $NH_4OH$ | 3.47 | | | | | | | |
| 59 | EtOH | 60 | 40.46 | $NH_4Cl$ | 3 | 1.5 | 12 | 9.4–8.9 | 15.9 |
| | $H_2O$ | 76 | | $H_2O$ | 30 | | | | |
| | $BrC_2H_4OH$ | 55.02 | | | | | | | |
| | $NH_4Cl$ | 9.05 | | | | | | | |
| | $NH_4OH$ | 11.56 | | | | | | | |

TABLE 4E

| Run No. | Catholyte Comp. | Catholyte gm. | $BrC_2H_4OH$ (wt %) | Anolyte comp. | Anolyte gm. | Current amp. | Current amp.-Hr. | pH range | Yield (wt %) |
|---|---|---|---|---|---|---|---|---|---|
| 51 | EtOH | 106.56 | 9.07 | $NH_4Cl$ | 3 | 1.5 | 6 | 9.3–9.0 | 1.53 |
| | $H_2O$ | 45 | | $H_2O$ | 30 | | | | |
| | $BrC_2H_4OH$ | 13.75 | | | | | | | |
| | $NH_4Cl$ | 9.63 | | | | | | | |
| | $NH_4OH$ | 12.24 | | | | | | | |
| 68 | EtOH | 26.05 | 38.35 | $NH_4Cl$ | 0.5 | 0.6 | 1.2 | 8.85–9.05 | 8.5 |
| | $H_2O$ | 11 | | $H_2O$ | 4.5 | | | | |
| | $BrC_2H_4OH$ | 14.21 | | | | | | | |
| | $NH_4Cl$ | 2.73 | | | | | | | |
| | $NH_4OH$ | 3.47 | | | | | | | |

TABLE 4F

| Run No. | Catholyte Comp. | Catholyte gm. | $BrC_2H_4OH$ (wt %) | Anolyte comp. | Anolyte gm. | Current amp. | Current amp.-Hr. | pH range | Yield (wt %) |
|---|---|---|---|---|---|---|---|---|---|
| 54 | EtOH | 62.35 | 8.55 | $H_2SO_4$ | 5.6 | 1.5 | 3 | 10.4–7.2 | 2.34 |
| | $H_2O$ | 79 | | $H_2O$ | 100 | | | | |
| | $BrC_2H_4OH$ | 12.09 | | | | | | | |
| | $Me_4NCl$ | 15.82 | | | | | | | |
| | $Me_4NOH$ | 27.4 | | | | | | | |
| 57 | EtOH | 63.63 | 16.95 | $H_2SO_4$ | 5.6 | 1.5 | 6 | 9.85–8.15 | 5.79 |
| | $H_2O$ | 80.61 | | $H_2O$ | 100 | | | | |
| | $BrC_2H_4OH$ | 24.45 | | | | | | | |
| | $Bu_4NCl$ | 25 | | | | | | | |
| | $NH_4OH$ | 10.88 | | | | | | | |
| 65 | EtOH | 13.42 | 46.71 | $NH_4Cl$ | 0.5 | 0.6 | 1.2 | 8.9–9.2 | 0.52 |
| | $H_2O$ | 17 | | $H_2O$ | 4.5 | | | | |
| | $BrC_2H_4OH$ | 14.21 | | | | | | | |
| | $Bu_4NCl$ | 14.2 | | | | | | | |
| | $NH_4OH$ | 3.47 | | | | | | | |
| 82 | EtOH | 16.58 | 37.81 | $NH_4Cl$ | 0.7 | 0.6 | 1.2 | 8.95–9.15 | 1.86 |
| | $H_2O$ | 21 | | $H_2O$ | 6.3 | | | | |
| | $BrC_2H_4OH$ | 14.21 | | | | | | | |
| | $Me_4NCl$ | 5.59 | | | | | | | |
| | $NH_4OH$ | 3.47 | | | | | | | |

TABLE 4G

| Run No. | Catholyte Comp. | Catholyte gm. | $BrC_2H_4OH$ (wt %) | Anolyte comp. | Anolyte gm. | Current amp. | Current amp.-Hr. | pH range | Yield (wt %) |
|---|---|---|---|---|---|---|---|---|---|
| 67 | EtOH | 0 | 32.30 | $NH_4Cl$ | 0.5 | 0.6 | 1.2 | 8.5–9.2 | 0.2 |
| | $H_2O$ | 44 | | $H_2O$ | 4.5 | | | | |
| | $BrC_2H_4OH$ | 14.21 | | | | | | | |
| | $Na_2CO_3$ | 1.35 | | | | | | | |
| | $NaHCO_3$ | 2.14 | | | | | | | |
| | NaCl | 2.98 | | | | | | | |
| 81 | EtOH | 15.79 | 39.70 | $NH_4Cl$ | 0.7 | 0.6 | 1.2 | 7.5–9.0 | 2.04 |
| | $H_2O$ | 20 | | $H_2O$ | 6.3 | | | | |
| | $BrC_2H_4OH$ | 14.21 | | | | | | | |
| | EDA 2HCl | 6.79 | | | | | | | |
| | $NH_4OH$ | 3.47 | | | | | | | |
| 83 | EtOH | 17.36 | 36.10 | $NH_4Cl$ | 0.7 | 0.6 | 1.2 | 8.85–9.3 | 4.58 |
| | $H_2O$ | 22 | | $H_2O$ | 6.3 | | | | |
| | $BrC_2H_4OH$ | 14.21 | | | | | | | |
| | $MeNH_2 . HCl$ | 3.45 | | | | | | | |
| | $NH_4OH$ | 3.47 | | | | | | | |
| 86 | EtOH | 17.36 | 36.10 | $NH_4Cl$ | 0.7 | 0.6 | 1.2 | 9.6–10.0 | 4.92 |
| | $H_2O$ | 22 | | $H_2O$ | 6.3 | | | | |
| | $BrC_2H_4OH$ | 14.21 | | | | | | | |
| | NaCl | 3.0 | | | | | | | |

TABLE 4G-continued

| Run | Catholyte | | $BrC_2H_4OH$ | Anolyte | | Current | | pH | Yield |
|---|---|---|---|---|---|---|---|---|---|
| No. | Comp. | gm. | (wt %) | comp. | gm. | amp. | amp.-Hr. | range | (wt %) |
| | $NH_4OH$ | 3.47 | | | | | | | |

TABLE 4H

| Run | Catholyte | | $BrC_2H_4OH$ | Anolyte | | Current | | pH | Yield |
|---|---|---|---|---|---|---|---|---|---|
| No. | Comp. | gm. | (wt %) | comp. | gm. | amp. | amp.-Hr. | range | (wt %) |
| 90 | EtOH | 17.36 | 34.93 | $NH_4Cl$ | 0.7 | 0.6 | 1.2 | 8.7–9.2 | 18.5 |
| | $H_2O$ | 22 | | $H_2O$ | 6.3 | | | | |
| | $IC_2H_4OH$ | 13.75 | | | | | | | |
| | $NH_4Cl$ | 2.73 | | | | | | | |
| | $NH_4OH$ | 3.47 | | | | | | | |

*$NH_4Cl$ is a 28% aqueous solution and values reported in milliliters in tables.
$H_2SO_4$ is a 10% aqueous solution and values reported in milliliters in tables.
All run numbers 62 and above have anolyte as 10% aqueous $NH_4Cl$ and values reported in milliliters in tables.

The above-tabulated results demonstrate a variety of factors which are important in the present process. Initially, runs nos. 60, 64, 69 and 76 in Table 4A show that no yield of diol product is obtained when the bath is very acidic. At bath pHs of around 7, some diol yield may be realized; however, in view of all of the runs in this example, bath pHs of above 8 and advantageously around 9 clearly provide better diol yields and are preferred for the process.

A comparison of runs 48, 49, 52, 53 and 55 in Table 4B with runs 50, 56, and 58 in Table 4C shows that increased feedstock concentrations apparently provide increased yields. Yet, a comparison of runs 50, 56, and 58 with run 61 in Table 4C shows that increased current provides much higher yields than are realized with increased feedstock concentrations at the same current rate. Runs 66, 84, 70, 63 and 59 in Table 4D show that substantially higher feedstock concentrations do not provide equivalent yields at lower currents than lower feedstock concentrations and higher currents.

Runs 51 and 68 in Table 4E show that higher ethanol:water weight ratios in the process apparently do not result in decreased yields of diol. Here, increased feedstock concentration did provide a trend towards higher yields at lower currents.

Runs 54, 57, 65, and 82 in Table 4F demonstrate that quaternary ammonium catholytes can be used in the process. While yields of diol are not great, the desired diol is made nevertheless. Runs 67, 81, 83, and 86 in Table 4G show other usable catholytes in the process also. Runs 54, 57, and 84 also show different anolytes in the process.

Run 90 in Table 4H demonstrates that ethylene iodohydrin is a suitable feedstock for the present process. While optimum reactants and conditions have not been determined in the process, still a wide variety of reactants and conditions have been shown to be operable in the process. Note, that the bath temperature in most of the runs was about 22° C. and in the other runs was 10° C.

EXAMPLE 5

In this example, solid copper cathodes were evaluated. The cylindrical solid plates in the runs had been prepared and treated differently, i.e. electropolished (Pol) electroplated (Pla), and buffed (Buf). These abbreviations will be set forth in the following table to describe the preparation of such electrode. The results obtained in this example are set forth below.

TABLE 5

| Run | Catholyte | | $BrC_2H_4OH$ | Anolyte | | Current | | pH | Yield |
|---|---|---|---|---|---|---|---|---|---|
| No. | Comp. | gm. | (wt %) | comp. | gm. | amp. | amp.-Hr. | range | (wt %) |
| 22 (Pla) | EtOH | 78.93 | 9.61 | TET | 5 | 0.3 | 4.8 | 7.5 | 1 |
| | $H_2O$ | 100 | | $H_2O$ | 30 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 24 (Pla) | EtOH | 78.93 | 9.61 | TET | 5 | 1.0 | 1.0 | 9.0 | 1 |
| | $H_2O$ | 100 | | $H_2O$ | 30 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 25 (Pla) | EtOH | 78.93 | 9.61 | TET | 5 | 1.0 | 1.0 | 9.0 | 0 |
| | $H_2O$ | 100 | | $H_2O$ | 30 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 23 (Pla) | EtOH | 78.93 | 9.61 | TET | 5 | 1.8 | 1.35 | 9.0 | 1 |
| | $H_2O$ | 100 | | $H_2O$ | 30 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 40 (Pla) | EtOH | 39.5 | 8.54 | $NH_4Cl$ | .75 | .57 | 1.71 | 8.9–9.0 | 0 |
| | $H_2O$ | 50 | | $H_2O$ | 15 | | | | |
| | $BrC_2H_4OH$ | 7.64 | | | | | | | |
| | $NH_4Cl$ | 5.3 | | | | | | | |
| | $NH_4OH$ | 6.75 | | | | | | | |
| 42 (Pla) | EtOH | 0 | 7.64 | $NH_4Cl$ | .75 | .57 | 1.71 | 9.5–9.05 | 0 |

TABLE 5-continued

| Run No. | Catholyte Comp. | Catholyte gm. | $BrC_2H_4OH$ (wt %) | Anolyte comp. | Anolyte gm. | Current amp. | Current amp.-Hr. | pH range | Yield (wt %) |
|---|---|---|---|---|---|---|---|---|---|
| | $H_2O$ | 120 | | $H_2O$ | 15 | | | | |
| | $BrC_2H_4OH$ | 9.17 | | | | | | | |
| | $NH_4Cl$ | 6.3 | | | | | | | |
| | $NH_4OH$ | 8.1 | | | | | | | |
| 43 (Pla) | EtOH | 0 | 7.64 | NaCl | .75 | .57 | 1.71 | 9.5–4.75 | 0 |
| | $H_2O$ | 120 | | $H_2O$ | 15 | | | | |
| | $BrC_2H_4OH$ | 9.17 | | | | | | | |
| | NaCl | 14 | | | | | | | |
| 44 (Pla) | EtOH | 0 | 7.64 | NaCl | .75 | .57 | 1.71 | 8.95–9.2 | 0 |
| | $H_2O$ | 120 | | $H_2O$ | 15 | | | | |
| | $BrC_2H_4OH$ | 9.17 | | | | | | | |
| | NaCl | 14.0 | | | | | | | |
| | $B(OH)_3$ | 7.0 | | | | | | | |
| 45 (Pla) | EtOH | 0 | 7.64 | NaCl | .75 | .57 | 1.71 | 9.0–9.4 | 0 |
| | $H_2O$ | 120 | | $H_2O$ | 15 | | | | |
| | $BrC_2H_4OH$ | 9.17 | | | | | | | |
| | NaCl | 7.0 | | | | | | | |
| | $NH_4CO_3$ | 7.5 | | | | | | | |
| 20 (Pol) | EtOH | 78.93 | 9.61 | TET | 10 | 2.0 | 4.0 | 9.0 | 12 |
| | $H_2O$ | 100 | | $H_2O$ | 60 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 37 (Pol) | EtOH | 78.93 | 9.61 | $NH_4Cl$ | 0.75 | .6 | .9 | 9.0 | 0 |
| | $H_2O$ | 100 | | $H_2O$ | 15.0 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 78 (Pol) | EtOH | 17.4 | 41.62 | $NH_4Cl$ | 0.7 | .15 | .60 | 8.9–9.0 | 0 |
| | $H_2O$ | 22 | | $H_2O$ | 6.3 | | | | |
| | $BrC_2H_4OH$ | 16.4 | | | | | | | |
| | $NH_4Cl$ | 2.73 | | | | | | | |
| | $NH_4OH$ | 3.47 | | | | | | | |
| 80 (Pol) | EtOH | 17.4 | 41.62 | $NH_4Cl$ | 0.7 | .30 | 1.2 | 8.9–9.1 | 0.27 |
| | $H_2O$ | 22 | | $H_2O$ | 6.3 | | | | |
| | $BrC_2H_4OH$ | 16.4 | | | | | | | |
| | $NH_4Cl$ | 2.73 | | | | | | | |
| | $NH_4OH$ | 3.47 | | | | | | | |
| 87 (Pol) | EtOH | 17.4 | 41.62 | $NH_4Cl$ | 0.7 | .60 | 2.4 | 8.8–9.1 | 3.49 |
| | $H_2O$ | 22 | | $H_2O$ | 6.3 | | | | |
| | $BrC_2H_4OH$ | 16.4 | | | | | | | |
| | $NH_4Cl$ | 2.73 | | | | | | | |
| | $NH_4OH$ | 3.47 | | | | | | | |
| 77 (Buf) | EtOH | 0 | 74.55 | $NH_4Cl$ | 0.7 | 0.15 | 0.6 | 8.9–9.0 | 0 |
| | $H_2O$ | 22 | | $H_2O$ | 6.3 | | | | |
| | $BrC_2H_4OH$ | 16.4 | | | | | | | |
| | $NH_4Cl$ | 2.73 | | | | | | | |
| | $NH_4OH$ | 3.47 | | | | | | | |

The above-tabulated results show that plate cathodes in general do not permit diol production unless the current is rather high (runs 20, 80, and 87). Since screen cathodes provide much larger yields compared to plate cathodes, thus the preference for high surface area cathodes in the present process.

EXAMPLE 6

In this example, several metals other than copper were evaluated for their suitability as cathodes in the present process. The metals were electroplated onto the copper alloy screen except for the mercury cathode which was a pool at the bottom of the cell. The following results were obtained.

TABLE 6

| Run No. | Catholyte Comp. | Catholyte gm. | $BrC_2H_4OH$ (wt %) | Anolyte comp. | Anolyte gm. | Current amp. | Current amp.-Hr. | pH range | Yield (wt %) |
|---|---|---|---|---|---|---|---|---|---|
| 19a Hg | EtOH | 78.9 | 9.61 | TET | 10 | 0.2 | 4.5 | 9.0–8.3 | 0 |
| | $H_2O$ | 100 | | $H_2O$ | 65 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 19b Hg | EtOH | 78.9 | 9.61 | TET | 10 | 1.5 | 9.75 | 8.3–6.3 | 0 |
| | $H_2O$ | 100 | | $H_2O$ | 65 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 19c Hg | EtOH | 78.9 | 9.61 | TET | 10 | 1.5 | 16.5 | 6.3 | 0 |
| | $H_2O$ | 100 | | $H_2O$ | 65 | | | | |
| | $BrC_2H_4OH$ | 17.2 | | | | | | | |
| | $NH_4Cl$ | 10.7 | | | | | | | |
| | $NH_4OH$ | 14 | | | | | | | |

TABLE 6-continued

| Run | Catholyte | | $BrC_2H_4OH$ | Anolyte | | Current | | pH | Yield |
|---|---|---|---|---|---|---|---|---|---|
| No. | Comp. | gm. | (wt %) | comp. | gm. | amp. | amp.-Hr. | range | (wt %) |
| 26 Hg | EtOH | 78.9 | 9.61 | TET | 10 | 1.5 | 1.0 | 9.0 | 0 |
| | $H_2O$ | 100 | | $H_2O$ | 65 | | | | |
| | $BrC_2H_4OH$ | 17.2 | | | | | | | |
| | $NH_4Cl$ | 10.7 | | | | | | | |
| | $NH_4OH$ | 14 | | | | | | | |
| 71 Hg | EtOH | 14.60 | 36.01 | $NH_4Cl$ | 0.5 | 0.6 | 1.2 | 9.05–9.25 | 0 |
| | $H_2O$ | 18.5 | | $H_2O$ | 4.5 | | | | |
| | $BrC_2H_4OH$ | 11.92 | | | | | | | |
| | $NH_4Cl$ | 2.3 | | | | | | | |
| | $NH_4OH$ | 2.82 | | | | | | | |
| 74 Pb | EtOH | 17.36 | 36.10 | $NH_4Cl$ | 0.7 | 0.6 | 1.2 | 8.95–9.2 | 0 |
| | $H_2O$ | 22 | | $H_2O$ | 6.3 | | | | |
| | $BrC_2H_4OH$ | 14.21 | | | | | | | |
| | $NH_4Cl$ | 2.73 | | | | | | | |
| | $NH_4OH$ | 3.47 | | | | | | | |
| 72 Ag | EtOH | 17.36 | 36.10 | $NH_4Cl$ | 0.7 | 0.6 | 1.2 | 8.9–9.2 | 1.21 |
| | $H_2O$ | 22 | | $H_2O$ | 6.3 | | | | |
| | $BrC_2H_4OH$ | 14.21 | | | | | | | |
| | $NH_4Cl$ | 2.73 | | | | | | | |
| | $NH_4OH$ | 3.47 | | | | | | | |
| 73 Zn | EtOH | 17.36 | 36.10 | $NH_4Cl$ | 0.7 | 0.6 | 1.2 | 8.8–9.0 | 1.99 |
| | $H_2O$ | 22 | | $H_2O$ | 6.3 | | | | |
| | $BrC_2H_4OH$ | 14.21 | | | | | | | |
| | $NH_4Cl$ | 2.73 | | | | | | | |
| | $NH_4OH$ | 3.47 | | | | | | | |
| 75 Ni | EtOH | 17.36 | 36.10 | $NH_4Cl$ | 0.7 | 0.6 | 1.2 | 8.95–9.1 | 3.09 |
| | $H_2O$ | 22 | | $H_2O$ | 6.3 | | | | |
| | $BrC_2H_4OH$ | 14.21 | | | | | | | |
| | $NH_4Cl$ | 2.73 | | | | | | | |
| | $NH_4OH$ | 3.47 | | | | | | | |

The above-tabulated results show that Hg and Pb are unsuitable as cathode material for the present process but that Ag, Zn and Ni are suitable materials.

EXAMPLE 7

In this example, run 89 utilizes the CuI electrolytic reductive plating process for preparing the copper screen electrode as proposed by Hammett et al, supra. The following result was obtained.

TABLE 7

| Run | Catholyte | | $BrC_2H_4OH$ | Anolyte | | Current | | pH | Yield |
|---|---|---|---|---|---|---|---|---|---|
| No. | Comp. | gm. | (wt %) | comp. | gm. | amp. | amp.-Hr. | range | (wt %) |
| 89 | EtOH | 17.36 | 36.10 | $NH_4Cl$ | 0.7 | 0.6 | 1.2 | 8.3–9.1 | 5.29 |
| Reduced | $H_2O$ | 22 | | $H_2O$ | 6.3 | | | | |
| Cut | $BrC_2H_4OH$ | 14.21 | | | | | | | |
| | $NH_4Cl$ | 2.73 | | | | | | | |
| | $NH_4OH$ | 3.47 | | | | | | | |

The above-tabulated result demonstrates that the copper coating can be deposited on the cathode substrate via reduced CuI.

In all the foregoing Examples, conversions of the halohydrin feedstock to some product ranged from as low as about 20% on up to 100%. Conversions for most of the runs reported in the Examples, though, exceeded 60%–70% by weight.

I claim:

1. A method for electrochemically preparing an $\alpha$-,$\omega$-dihydroxy-terminated alkane from a polymethylene halohydrin which comprises:

establishing in an electrolytic cell an aqueous electrolytic bath comprising water, an electrolyte, an adequate proportion of a base to establish a pH in said bath not substantially below 7, and said polymethylene halohydrin where said halogen substituent is bromine or iodine and said polymethylene substituent contains between about 2 and 6 methylene groups, said cell having an anode and a cathode disposed in said bath, said cathode being copper, silver, nickel, or zinc;

impressing an electric potential between said anode and said cathode to generate a current through said bath to cathodically couple the electrolyed polymethylene halohydrin to form said dihydroxy-terminated alkane, said pH of said bath being maintained not substantially below 7 during said potential impressing.

2. The method of claim 1 wherein said dihydroxy-terminated alkane comprises butane-1,4-diol.

3. The method of claim 1 wherein said bath also contains a water-soluble organic solvent.

4. The method of claim 3 wherein said organic solvent is an alcohol or a glycol.

5. The method of claim 4 wherein said alcohol is ethanol.

6. The method of claim 5 wherein the weight ratio of water to ethanol ranges from about 10:1 to about 1:5.

7. The method of claim 6 wherein said weight ratio is about 1:0.8.

8. The method of claim 2 wherein said cathode is copper.

9. The method of claim 1 wherein said cathode is copper.

10. The method of claim 9 wherein said copper is in plated form on a cathode substrate.

11. The method of claim 10 wherein said cathode substrate is a copper material.

12. The method of claim 1 wherein said pH is maintained between about 8 and 10.

13. The method of claim 1 wherein said base is an alkali metal base, an ammonium base, or a quaternary ammonium base.

14. The method of claim 13 wherein said base is ammonium hydroxide.

15. The method of claim 13 wherein said base is a hydroxide.

16. The method of claim 1 wherein said cell is divided by a porous membrane to form an anode compartment and a cathode compartment, and said halohydrin is established in said cathode compartment.

17. The method of claim 16 wherein said bath in said cathode compartment contains a catholyte and said bath in said anode compartment contains an anolyte.

18. The method of claim 17 wherein said catholyte is an amine salt, an ammonium salt, or a quaternary ammonium salt.

19. The method of claim 18 wherein said catholyte is an ammonium salt.

20. The method of claim 19 wherein said catholyte is an ammonium halide.

21. The method of claim 18 wherein said anolyte and said catholyte are of the same composition.

22. The method of claim 2 wherein said halohydrin is bromoethanol or iodoethanol.

23. The method of claims 1 or 22 wherein by-product ethylene and halide are removed from said cell and reacted to form additional halohydrin which is recycled to said cell.

24. The method of claim 1 or 12 wherein additional base is added to said cell during said potential impressment to maintain said pH in said cell.

25. The method of claim 18 wherein said halohydrin is bromoethanol or iodoethanol, said organic solvent is an alcohol or a glycol, and said base is an ammonium or a quaternary ammonium base.

26. The method of claim 25 wherein said organic solvent is ethanol and said base is a hydroxide.

27. The method of claim 26 wherein said base is ammonium hydroxide, said catholyte is an ammonium salt, and the pH established and maintained is between about 8 and 10.

28. The method of claim 27 wherein said cathode is copper in plated form on a copper material cathode substrate.

29. The method of claim 28 wherein the current through said bath is between about 0.5 and 3 amps.

30. The method of claim 1 wherein said cathode is in the shape of a screen.

31. The method of claim 29 wherein said cathode is in the shape of a screen.

32. The method of claim 1 or 2 wherein said cathode is silver, nickel, or zinc.

33. The method of claim 1 or 22 wherein said by-product halide is reacted with ethylene and said halohydrin recycled to said cell.

34. The method of claim 1 which is a continuous method.

* * * * *